US007072485B2

(12) United States Patent
Sato et al.

(10) Patent No.: US 7,072,485 B2
(45) Date of Patent: Jul. 4, 2006

(54) METHOD FOR MANUFACTURING DIAPHRAGM FOR LOUDSPEAKER, DIAPHRAGM FOR LOUDSPEAKER MADE THEREBY, AND LOUDSPEAKER USING THE SAME

(75) Inventors: Hitoshi Sato, Mie (JP); Sinya Mizone, Mie (JP); Kiyoshi Ikeda, Mie (JP); Hiroko Yamazaki, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 431 days.

(21) Appl. No.: 10/613,455

(22) Filed: Jul. 3, 2003

(65) Prior Publication Data

US 2004/0094356 A1 May 20, 2004

Related U.S. Application Data

(62) Division of application No. 09/485,037, filed as application No. PCT/JP99/03140 on Jun. 11, 1999, now Pat. No. 6,627,140.

(30) Foreign Application Priority Data

Jun. 12, 1998 (JP) ..... 10-164892

(51) Int. Cl.
*H04R 25/00* (2006.01)

(52) U.S. Cl. ..... 381/423; 381/426; 264/483

(58) Field of Classification Search ..... 381/423, 381/424, 426, 428; 181/157, 167, 169, 170, 181/171, 172; 428/408; 264/483, 320, 328.1; 29/594, 609.1

See application file for complete search history.

(56) References Cited

U.S. PATENT DOCUMENTS 4,772,513 A * 9/1988 Sakamoto et al. ..... 428/408
6,627,140 B1 * 9/2003 Sato et al. ..... 264/483

FOREIGN PATENT DOCUMENTS

| | | |
|---|---|---|
| EP | 0-341-589 A | 11/1989 |
| JP | 60-048696 A | 3/1985 |
| JP | 60-48696 A | 3/1985 |
| JP | 01-279699 A | 11/1989 |
| JP | 05-168903 | 2/1993 |
| JP | 06-225388 | 8/1994 |

OTHER PUBLICATIONS

European Search Report corresponding application No. EP 99-92-4013 dated Jan. 17, 2005.
Japanese search report for PCT/JP99/03140 dated Aug. 24, 1999.

* cited by examiner

*Primary Examiner*—Huyen Le
(74) *Attorney, Agent, or Firm*—RatnerPrestia

(57) ABSTRACT

A meshed etching tunnel made of aluminum is disposed inside a cylindrical quartz reactive chamber, and speaker diaphragms are aligned inside the tunnel at a certain interval. Opposing electrodes are disposed outside the reactive chamber. Plasma is applied at low temperature to prevent heat deformation. Uniform wettability is also assured by the use of the meshed etching tunnel, achieving high productivity. Uniform wettability further stabilizes bonding and improves bonding strength of the speaker diaphragm onto the voice coil and edge, offering a speaker with improved input power durability.

6 Claims, 5 Drawing Sheets

METHOD FOR MANUFACTURING DIAPHRAGM FOR LOUDSPEAKER, DIAPHRAGM FOR LOUDSPEAKER MADE THEREBY, AND LOUDSPEAKER USING THE SAME

This application is a divisional of U.S. patent application Ser. No. 09/485,037, filed May 22, 2000 now U.S. Pat. No. 6,627,140.

This application is a U.S. national phase application of PCT International application PCT/JP99/03140.

FIELD OF THE INVENTION

The present invention relates to the field of methods for manufacturing speaker diaphragms employed in a range of audio equipment, speaker diaphragms made using such methods, and speakers employing such diaphragms.

BACKGROUND OF THE INVENTION

The configuration of a conventional speaker is described with reference to its sectional view in FIG. 7. A magnetic circuit 15 includes a magnet 15*a*, lower plate 15*b*, and upper plate 15*c*.

A frame 16 is bonded to the magnetic circuit 15. A damper 17 holds a voice coil 18. The outer circumference of the damper 17 is bonded to the frame 16, and its inner circumference is bonded to the voice coil 18 whose coil 18*a* is embedded in the magnetic gap 15*d* of the magnetic circuit 15.

A speaker diaphragm 19 is bonded to the frame 16 via an edge 19*a* bonded to its outer circumference, and the inner circumference of the speaker diaphragm 19 is bonded to the voice coil 18. This speaker diaphragm 19 is generally made mainly of paper or thin resin plates, which is selected depending on the need for weather resistance and required acoustic characteristics.

A method for manufacturing a typical speaker diaphragm 19 made of resin, more specifically a polyolefin polyethylene speaker diaphragm is described next.

A speaker diaphragm made of polyethylene, which is a type of polyolefin system, has low material density which gives the speaker diaphragm a low mass. It also has relatively large internal loss with respect to mechanical vibration, which improves the frequency characteristic of the speaker. Accordingly, polyethylene speaker diaphragms are commonly used in speakers. However, a polyethylene speaker diaphragm has low adhesivity, making it essential to activate the surface of the speaker diaphragm to improve bonding strength.

Common conventional methods for activating the surface of the speaker diaphragm 19 include the application of primer after corona discharge, and surface treatment of the speaker diaphragm 19 by the gas plasma treatment method using parallel flat electrodes 20 and 21 as shown in FIGS. 8 and 9.

However, the conventional surface activating technology for treating the surface of the speaker diaphragm has the following disadvantages.

As for the method involving surface activation by corona discharge and primer application, a large processing apparatus is required because only the areas close to electrodes 20 and 21 are activated if the electrodes are small, causing a deviation in wettability of the speaker diaphragm 19. In addition this treatment takes about 30 seconds for one face of the speaker diaphragm 19. The workpiece then needs to be flipped or the speaker diaphragm 19 needs to be flipped to apply treatment to the other face, requiring more than one minute for each piece and seriously degrading productivity.

Furthermore, it has another problem that the speaker diaphragm may deform during corona discharge due to high temperatures above 80° C. in the reactive chamber.

The method using the parallel flat electrode 20 in FIG. 8 also creates the risk of heat deformation and low productivity of the speaker diaphragm 19. The method using the parallel flat electrode 21 in FIG. 9 may also cause low productivity. If more, than one speaker diaphragm 19 is handled at once to solve the problem of low productivity, it may still have the risk of heat deformation, and significant difference in wettability between the periphery and the center.

The present invention aims to solve these disadvantages. By offering a method for manufacturing a speaker diaphragm assuring stable quality and high productivity, the present invention offers a speaker diaphragm with stable quality and a speaker employing such diaphragm.

SUMMARY OF THE INVENTION

To solve the conventional disadvantages, the method for manufacturing a speaker diaphragm of the present invention involves the next steps. A resin speaker diaphragm made by injection molding or sheet forming by heating is disposed in a reactive chamber, and electrodes are provided outside of the reactive chamber. Plasma is applied to the speaker diaphragm to activate the surface. Provision of electrodes outside the reactive chamber enables to keep the temperature of the reactive chamber below the heat deformation temperature of the speaker diaphragm during plasma treatment. Accordingly, heat deformation of the speaker diaphragm is preventable and defects caused by heat deformation can be suppressed.

Figure 1:
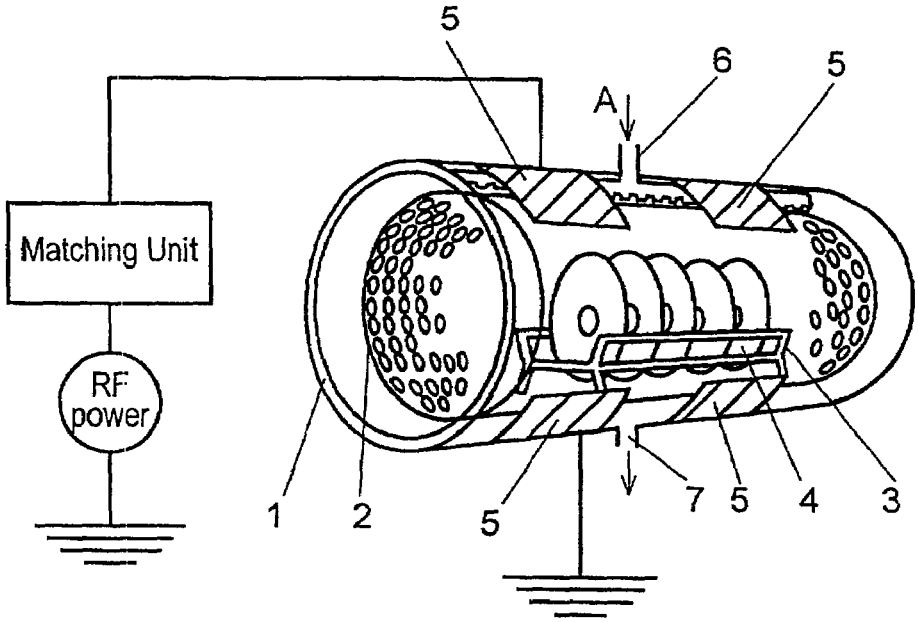
FIG. 1 is a perspective view illustrating a method for manufacturing a speaker diaphragm in an exemplary embodiment of the present invention for describing plasma treatment of the speaker diaphragm.

The entire disclosure of U.S. patent application Ser. No. 09/485,037, filed May 22, 2000, is expressly incorporated by reference herein.

DESCRIPTION OF THE PREFERRED EMBODIMENT

First Exemplary Embodiment

A method for manufacturing a speaker diaphragm in an exemplary embodiment of the present invention is described with reference to FIGS. 1 to 6. The configuration of the speaker itself is the same as that of the prior art, and thus its explanation is omitted here.

In FIGS. 1 to 6, a meshed cylindrical aluminum etching tunnel 2 is provided inside a cylindrical quartz reactive chamber 1. A speaker diaphragm 4 (corresponding to the speaker diaphragm 19 in the prior art) is held by a speaker diaphragm holder 3 in the reactive chamber 1 in parallel with other speaker diaphragms at approximately equal intervals. A gas inlet 6 is provided on the reactive chamber 1, and reactive gas A flows in from this gas inlet 6 through the etching tunnel 2 formed of meshed aluminum to the reactive chamber 1. Two pairs of electrodes 5 are provided facing each other on the outside face of the reactive chamber 1. A gas outlet 7 is also provided.

Details of the method for manufacturing the speaker diaphragm 4 using the above reactive chamber 1 are described next. Ultra high polymer polyethylene resin called "LUBMER" (product name) manufactured by Mitsui Chemicals, Inc. is used for the speaker diaphragm 4. This "LUBMER" is formed into the speaker diaphragm 4, having a diameter of 16 cm by composite molding of injection or pressing, using an ultra high speed injection molding machine. The characteristics of this resin are shown in Table 1.

TABLE 1

| | | |
|---|---|---|
| Heat deformation temperature | 82 | ° C. |
| Melting point | 137 | ° C. |
| Water supply rate | 0.01> | % |
| Strength of tensile breakage point | 530 | $kg/cm^2$ |
| Elongation of breakage point | 7 | % |
| Bending strength | 18400 | $kg/cm^2$ |

It is apparent from Table 1 that this resin starts to deform at 82° C., and the speaker diaphragm 4 is exposed to the danger of deformation at the temperature 80° C. or above in the reactive chamber 1.

Figure 2:
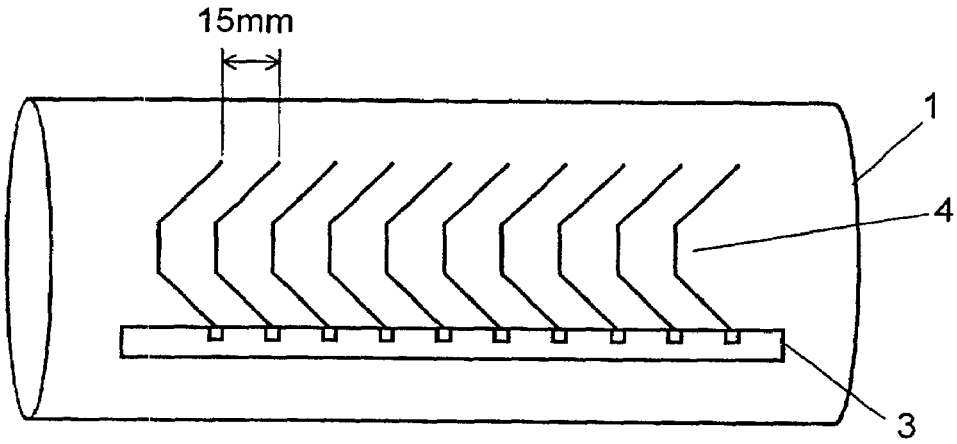
FIG. 2 is a sectional view illustrating the speaker diaphragm aligned in a quartz reactive chamber, which is a key part of the exemplary embodiment of the, present invention.

The size of the quartz reactive chamber 1 is 300 mm in diameter and 500 mm in length. As shown in FIG. 2, 30 speaker diaphragms 4 of diameter 16 cm are aligned at 15 mm intervals. For the reactive gas A, oxygen gas is employed.

Figure 3:
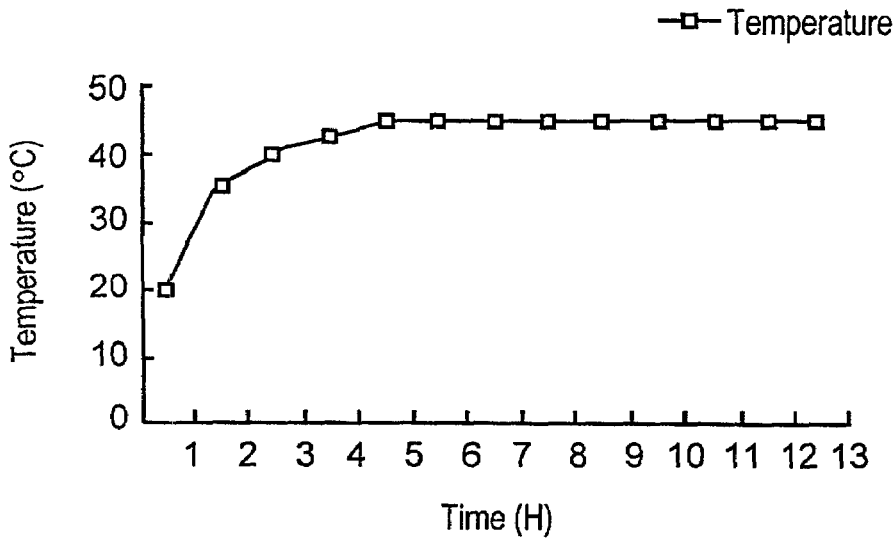
FIG. 3 is a temperature change graph during consecutive operation of the quartz reactive chamber in the exemplary embodiment of the present invention.

To achieve a vacuum of 0.9 torr under high frequency output of 500 W, the vacuuming time is set to 1.5 minutes, plasma treatment time to 1 minute, and the return to normal pressure 1.5 minutes, which totals about 4 minutes per cycle. FIG. 3 shows the changes in temperature during consecutive operations under the above conditions. As shown in FIG. 3, the temperature inside the reactive chamber is stabilized at about 45° C. even after consecutive operation for 12 hours, and no speaker diaphragm 4 was deformed.

The wettability of the speaker diaphragm 4 obtained through the above process is 50 dyn/cm or above on any part of the speaker diaphragm 4. This allows the assumption that plasma is applied uniformly by the use of the meshed etching tunnel 2.

Figure 4:
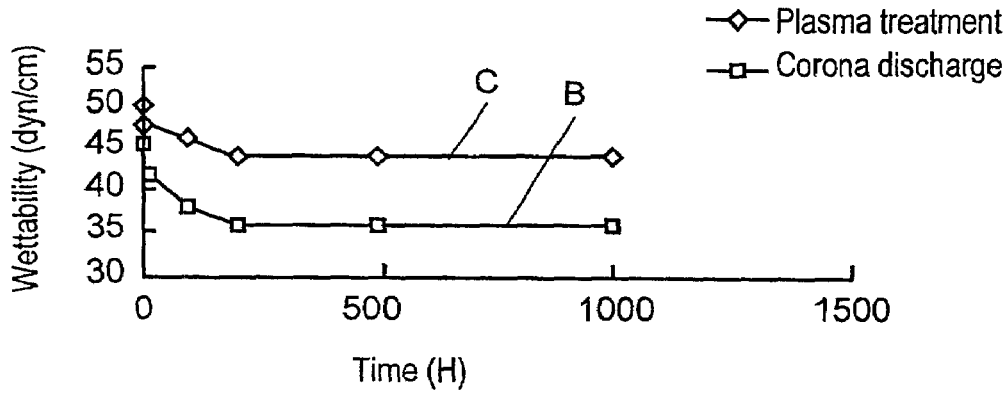
FIG. 4 is a comparison of durability of wettability in the exemplary embodiment of the present invention.

For further improving the, quality, isocyanate manufactured by Takeda Chemical Industries. Ltd., called "Takenate M402" (product name) is used as the primer. FIG. 4 shows the durability of its wettability.

It is apparent from FIG. 4 that the wettability B immediately after treatment in the conventional method of applying primer after corona discharge is relatively high at 46 dyn/cm. However, it degrades with time, falling to about 36 dyn/cm after 200 hours.

The exemplary embodiment in which the primer is applied after plasma treatment is shown as characteristic C in FIG. 4. It shows that the wettability immediately after treatment is a very high 50 dyn/cm, and the primer maintains a high wettability of 44 dyn/cm for considerable time, proving its stability.

Figure 5:
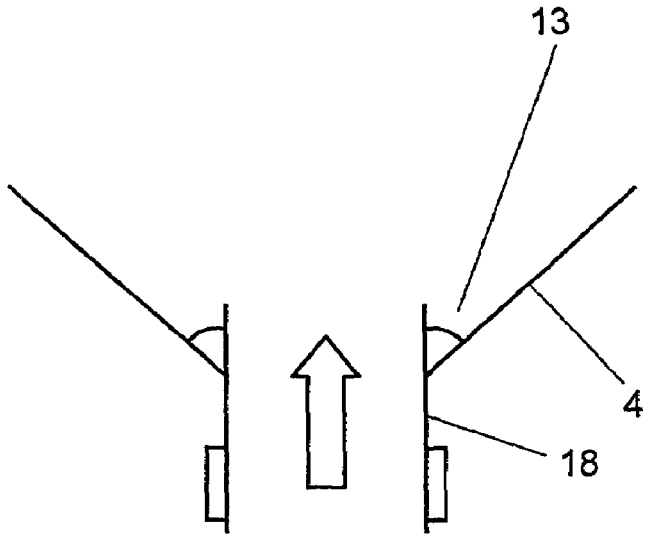
FIG. 5 is a sectional view illustrating the bonding state of the speaker diaphragm and a voice coil.
Figure 6:
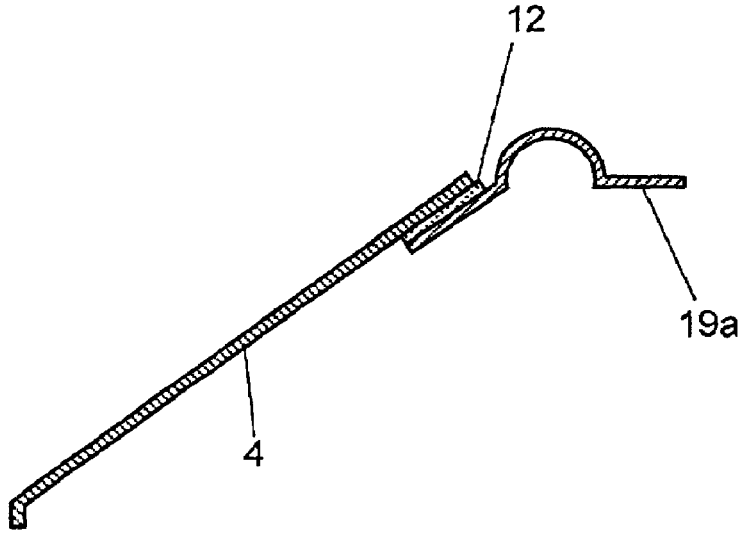
FIG. 6 is a sectional view illustrating the bonding state of the speaker diaphragm and an edge.
Figure 7:
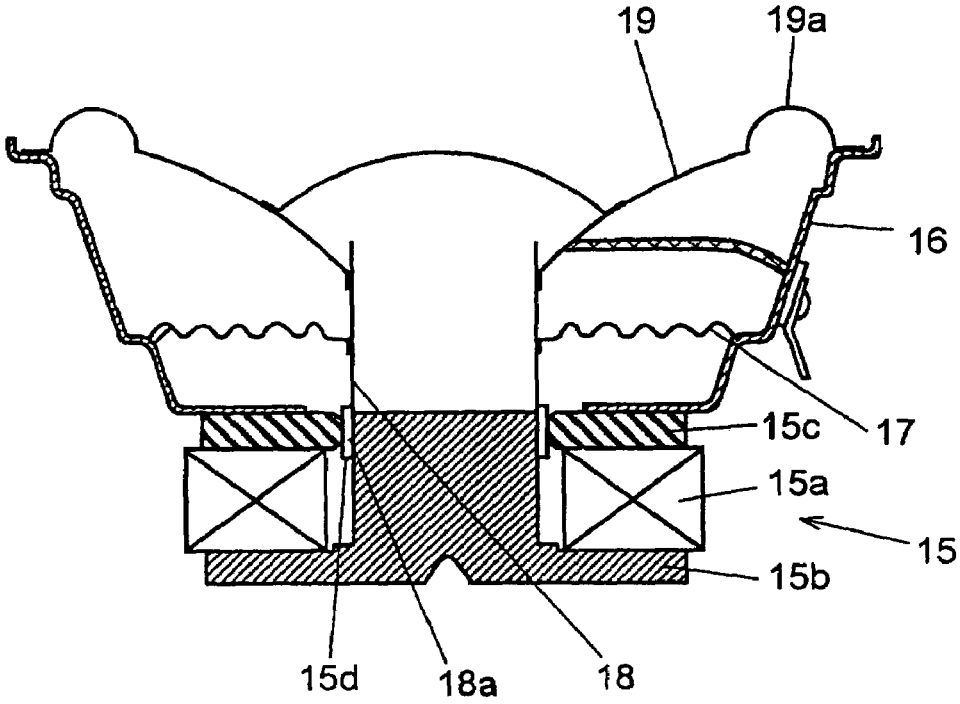
FIG. 7 PRIOR ART
FIG. 7 is a side sectional view of a conventional speaker.
Figure 8:
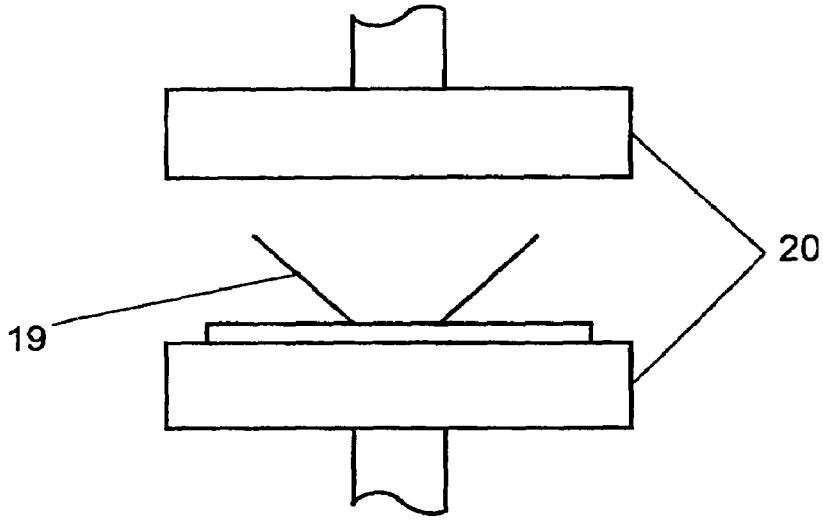
FIG. 8 PRIOR ART
FIG. 8 is a sectional view of an essential portion of a conventional speaker illustrating plasma treatment for the speaker diaphragm using parallel flat electrodes.
Figure 9:
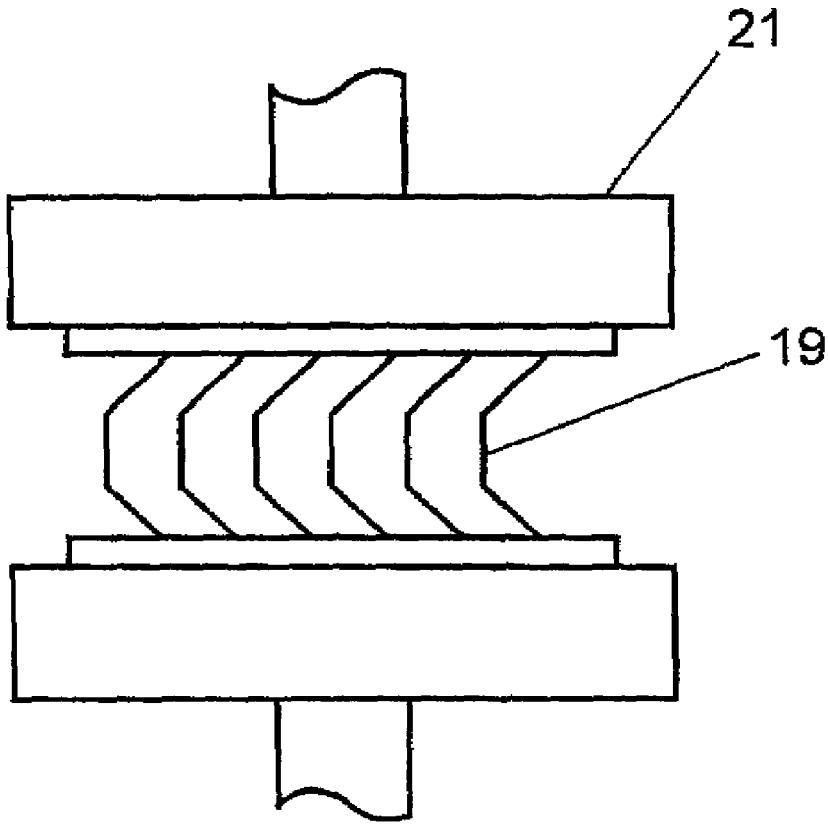
FIG. 9 PRIOR ART
FIG. 9 is a sectional view of an essential portion of a conventional speaker illustrating plasma treatment for the speaker diaphragm in FIG. 8 using another type of parallel flat electrodes.

Next, as shown in FIGS. 5 and 6, the strength was compared between the speaker diaphragm 4 to which the primer was applied after plasma treatment in this exemplary embodiment and the voice coil 18 and edge 19*a* were bonded using adhesives 12 and 13; and the conventional speaker diaphragm to which the primer was applied after corona discharge and the voice coil and edge were bonded.

The voice coil 18 shown in FIG. 5 has a diameter of 32 mm. The adhesive 13 is a two-part reactive acrylic adhesive, and it is used for bonding the voice coil 18 onto the speaker diaphragm 4. The bonding strength was measured by pulling the voice coil 18 in the direction indicated by the arrow.

The edge 19*a* shown in FIG. 6, is made of rubber, and it is bonded to the speaker diaphragm 4 using the adhesive 12 which is butyl rubber solvent adhesive. The peeling strength was tested using a bonding area of 25 mm wide and 5 mm long.

A Ø16 cm speaker was then made using the above Ø32 voice coil 18 and edge 19*a*, and the input power durability was tested. Table 2 shows the results of each test.

TABLE 2

| | plasma treatment | corona discharge |
|---|---|---|
| cone <=> voice coil | 18 kg | 11 kg |
| cone <=> edge | 4.5 kg | 2.5 kg |
| input power durability | 120 W | 70 W |
| (breakage mode) | damage to voice coil | peeling of bonding |

It is apparent from Table 2 that the speaker diaphragm of the exemplary embodiment which uses plasma treatment has better bonding strength than the conventional speaker diaphragm using corona discharge.

In the input power durability test, the bonded area has peeled off in the conventional speaker using corona discharge by input of 70 W. In the exemplary embodiment using plasma processing, burning of the voice coil 18 occurred by input of 120 W. However, no peeling of the bonded area has occurred, demonstrating extremely high bonding strength.

As for the reactive gas A, approximately the same results as for oxygen were obtained by the use of nitrogen gas or air. As for the material of the speaker diaphragm 4, approximately the same effect was obtained with polypropylene or nylon resin.

As described above, the exemplary embodiment provides electrodes 5 outside the reactive chamber 1 for plasma treatment. This enables the suppression of temperature rise in the reactive chamber 1 and prevents heat deformation of the speaker diaphragm 4. In addition, plasma can be uniformly applied by placing the speaker diaphragm 4 in a meshed metal frame, resulting in improved productivity.

INDUSTRIAL APPLICABILITY

The method for manufacturing a speaker diaphragm of the present invention disposes a resin speaker diaphragm made by injection molding or sheet forming by heating in the reactive chamber, and provides electrodes outside the reactive chamber. This enables the temperature inside the reactive chamber to be kept below the heat deformation temperature of the speaker diaphragm during surface activation of the speaker diaphragm by application of plasma. The temperature inside the reactive chamber is kept below the heat deformation temperature of the speaker diaphragm to prevent heat deformation of the speaker diaphragm and to suppress the occurrence of defects caused by heat deformation.

In addition, more than one speaker diaphragm is disposed inside the meshed metal frame in the reactive chamber at a predetermined interval to apply plasma almost uniformly. The gas disperses almost uniformly inside the reactive chamber through the meshed metal frame so that the surface is almost uniformly activated, assuring high wettability and stable high quality of the speaker diaphragm.

Moreover, application of isocyanate primer after plasma treatment further improves the bonding strength and stabilizes the quality.

The material used for the speaker diaphragm of the present invention is a monopolymer or copolymer of polyolefin resin such as polyethylene and polypropylene, or monopolymer or copolymer of polyamide resin. This enables a broad range of speaker diaphragms with improved bonding strength and stable quality to be manufactured.

A speaker manufactured using the speaker diaphragm manufactured as above thus has uniform and improved bonding strength between the speaker, diaphragm and edge and/or voice coils, offering speakers with improved input power durability.

What is claimed is:

1. A diaphragm for a loudspeaker manufactured in accordance with the steps of:

heating said diaphragm which is a molded resin speaker diaphragm in a reactive chamber which has an electrode for said reactive chamber disposed outside of said reactive chamber; and activating the surface of said diaphragm by applying plasma while keeping the temperature inside said reactive chamber below a heat deformation temperature of said diaphragm.

2. The diaphragm for a loudspeaker as defined in claim 1, wherein isocyanate primer is applied after plasma treatment.

3. The diaphragm for a loudspeaker as defined in claim 1, wherein one of monopolymer and copolymer of polyolefin is used as a material for said diaphragm.

4. The diaphragm for a loudspeaker as defined in claim 2, wherein one of monopolymer and copolymer of polyolefin is used as a material for said diaphragm.

5. The diaphragm for a loudspeaker as defined in claim 1, wherein said diaphragm is further manufactured in accordance with one of injection molding and sheet forming.

6. The diaphragm for a loudspeaker as defined in claim 1, wherein said reactive chamber is disposed with a meshed metal frame inside said reactive chamber.

* * * * *